United States Patent [19]

Sahay

[11] 4,248,528

[45] Feb. 3, 1981

[54] COPIER WITH DOCUMENT SENSING CONTROL

[75] Inventor: Ravi B. Sahay, Penfield, N.Y.

[73] Assignee: Xerox Corporation, Stamford, Conn.

[21] Appl. No.: 27,131

[22] Filed: Apr. 4, 1979

[51] Int. Cl.[3] ..... G03G 14/00

[52] U.S. Cl. ..... 355/14 R; 271/3.1; 271/258; 355/6; 355/77

[58] Field of Search ..... 355/14 R, 14 C, 3 R, 355/3 SH, 14 SH, 6, 77; 271/3.1, 4, 258, 263; 235/92 CT, 92 SB

[56] References Cited

U.S. PATENT DOCUMENTS

| | | | |
|---|---|---|---|
| 3,562,491 | 2/1971 | Branfield | 235/92 SB |
| 3,700,324 | 10/1972 | Hutner et al. | 355/6 |
| 3,917,924 | 11/1975 | Linne | 235/61.6 L |
| 4,126,390 | 11/1978 | Connin | 355/14 C |
| 4,157,822 | 6/1979 | Miller | 271/3.1 |

FOREIGN PATENT DOCUMENTS

| | | | |
|---|---|---|---|
| 2150563 | 4/1973 | Fed. Rep. of Germany | 355/14 R |
| 53-116841 | 10/1978 | Japan | 355/14 R |
| 53-131048 | 11/1978 | Japan | 355/14 R |
| 53-134437 | 11/1978 | Japan | 355/14 R |

*Primary Examiner*—R. L. Moses

[57] ABSTRACT

An improved copier control system in which preprinted and operator marked control sheets otherwise corresponding to the regular original document sheets being copied are fed together with those regular documents by the copier document feeder past an optical scanner connected to the copier controller. The document sheets are copied in the manner instructed by the preceeding control sheets, without requiring manual switch inputs, while the copying of the control sheet itself is automatically inhibited.

8 Claims, 4 Drawing Figures

COPIER WITH DOCUMENT SENSING CONTROL

For the faster and more sophisticated xerographic and other copiers now available, it is increasingly desirable to provide for fully automatic handling of the original documents being copied, and the copies being made, in order to more effectively utilize these higher speed and more flexible copying capabilities. It is desirable, and known, to handle a wide variety of such original documents with an integral document feeder, including documents with information indicia on one side (simplex) or both sides (duplex). It is desirable and known to provide documents from any of these documents which are selectively either simplex or duplex, and outputted in pre-collated or post-collated sets in sorted, stacked, and/or off-set or bound form. It is known to provide document feeders for this purpose which are semi-automatic or which are fully automatic and which are selectable between single or multiple document set recirculation modes of operation, i.e., for multiple copying of each document in one set circulation for post-collating (sorting), or single copying of each document in each of multiple recirculations to provide pre-collated copy sets. It is also desirable and known for the copier to be controllable by the operator to provide for variable magnifications (reductions) and other copying adjustments, such as adjustments in the image density or darkness, screening, etc.. Other desirable operator selectable features include the automatic inserting of cover or insert sheets of various materials, sizes, shapes, or colors into proper positions or locations in the copy sets, particularly so that fully completed finished copy sets or "books" are immediately available at the copier output or internally for binding, stapling, or stitching, without requiring manual sheet insertions or other manual copy handling.

Unfortunately, this increase in known functions and capabilities of copiers has resulted in an increase in the selections or choices which must be made by the operator to fully utilize the copier. Unlike simple copiers, in which the only visible operator controls may be a copy count selector for the number of copies, and "ON", "OFF", and "START" buttons, a modern sophisticated copier may present the operator with a large and confusing display of a large number of additional switches, buttons, dials, lights, instructions, etc.. To fully utilize the capabilities of the copying machine it may be necessary for the operator to locate and actuate various combinations of these manual switches and controls before the copying can commence. Furthermore, the operator may have to repeat this entire sequence of manual switch control steps for each desired copying job, even if that job is the same as ones previously run, e.g., a routine but unique printing job, such as a regular report, periodical, etc.. If different copying functions or features are to be provided for different documents in a set or stack of documents to be copied it may be additionally necessary to interrupt each copying run and the feeding of the documents several times in order to change or reset various switch settings to the different processing desired.

It is a feature of the present invention to overcome various of the above and other related problems and to thereby make easier, and encourage, the utilization of the full capabilities of a modern copying apparatus, particularly for the "casual operator" for whom operation of a copier is only an occasional, non-occupational, function. It is also intended to reduce the training or familiarization time required for the instructing of either regular or casual operators in the utilization of the copier.

It is a specific feature of this invention to provide improved and simplified control of a copier utilizing the existing document feeder which feeds conventionally sized original document sheets with conventional information indicia to a document imaging station to be copied onto selected copy sheets, which copier is conventionally controlled by an electronic controller connected to the document feeder, by providing the document feeder with a non-imaging optical scanning means which optically scans the sheets being fed by the document feeder with a non-imaging optical scanning means before they are copied to provide electrical pulses corresponding to light and dark indicia areas of the sheets, wherein control sheets of the same conventional document size range are inserted into the same document feeder in the same manner as the documents to be copied, and wherein the control sheets have a plurality of defined operator selectably markable indicia areas thereon, identified by pre-printed locating and identifying indicia adjacent the selectably markable areas corresponding to different desired operations of the copier, and wherein the operator marked, and other, indicia on the control sheets is read by the optical scanning means and the electrical pulses therefrom are connected to the copier controller to correspondingly control the operation of the copier as the control sheets are fed, but the copying of the control sheets themselves may be automatically inhibited by control indicia thereon. Automatic switching of the copying mode between simplex and duplex documents may also be provided.

It will be seen that with the system disclosed herein, that the entire copier operation, including the most sophisticated variable function or feature copying run of which the copier is capable, may be fully controlled simply by the operator marking a pre-printed ordinary sheet of paper with a pencil, pen, or other conventional marker at indicated locations and feeding this control sheet into the conventional document handler in the conventional manner as if it were to be conventionally copied. The control sheet will automatically switch the operation of the copier to the various other copying functions without the operator having to find or actuate any manual buttons or switches on the copier (other than possibly a "START" button, but the copier can even be of the known type which can be started automatically merely by the inserting of the first document sheet into the document feeder). If different copying modes or functions are desired for different documents in a stack or run, different control sheets differently so encoded may be inserted in the document stack ahead of the documents to be affected, and the copier may thus be automatically switched between different modes of operation for different documents as the documents are fed without any interruption of the normal document feeding by the operator. That is, the operator may pre-program the set of originals simply by merging in (interleaving) pre-coded control sheets as inserts ahead of the originals for which exceptional treatment is desired (variable density or variable magnification copying, different copy paper, inserts, or the like). Thus, job editing or control is simplified and does not require switch or keyboard inputs, counting of originals, interruptions of copying runs, manual inserts, etc.. Further, since the control sheets may be conventionally fed through the document feeder and ejected or restacked in the same manner as, and together with, the documents to be copied. They may be immediately, or at any time subsequently, re-used by being re-fed with the same, or other, documents to be copied.

The disclosed system desirably utilizes existing copier hardware, circuitry and document handling, and known sensor technology. The below cited references, and various other references cited therein, provide teachings of various usable additional or alternative systems or hardware incorporable herein, as they illustrate various copiers, copier document and sheet handling systems, and copier controllers, and various copier processing and control functions, which may be utilized or controlled with the present invention.

Previous systems are known in which certain copier functions can be controlled by punched card or tape or magnetic tape inserts into a reader/decoder connected to the copier controls, or other local or remote electronic control of desired copier functions. Examples are disclosed in U.S. Pat. No. 3,917,924 issued Nov. 4, 1975 to B. D. Linne and Japanese Application No. 5246131 laid open Nov. 15, 1976 as No. 53-131048. A recent publication notes optically scanning a document being copied to control the copier depending on whether the document is simplex or duplex (Japanese Application No. 52-31360 laid open Oct. 12, 1978 as 53-116841). Other recent publications on scanning copier controls include Japanese application No. 52-49125 laid open Nov. 24, 1978 as 53-134437.

Various manual switch controlled copiers with automatic document feeders and connecting copier controls are known, including those with optical jam detection, document sheet counting, job recovery, and other document feeder sensors with logic electronic interconnections with the copier controller. The features and internal controls in such copiers of the various above-noted and other copier functions by binary digital signals utilizing programmable microprocessor or other known digital electrical circuitry are well known from patents and other references and existing products such as the Xerox Corporation "9400" duplicator and, therefore, need not be described in detail herein. Some examples are disclosed in U.S. Pat. Nos. 3,963,345 issued June 15, 1976 to D. J. Stemmle et al.; 3,944,207 issued Mar. 16, 1976 to S. S. Bains; 4,018,523 issued Apr. 19, 1977 to E. L. Hughes; 4,012,032 issued Mar. 15, 1977 to J. C. Rogers; 4,062,061 issued Dec. 6, 1977 to P. J. Batchelor et al.; 4,076,408 issued Feb. 28, 1978 to M. G. Reid et al.; 4,078,787 issued Mar. 14, 1978 to L. E. Burlew et al.; 4,099,150 issued July 4, 1978 to J. L. Conin; 4,125,325 issued Nov. 14, 1978 to P. J. Batchelor et al.; and 4,144,550 issued Mar. 13, 1979 to J. K. Donohue et al..

Inlike a punch card or magnetic tape copier control, the present system does not require the expense and complexity of a separate input device, feeder, housing, etc.. Nor does it require an additional operator interface location on the copier. Rather, with the present system, the existing otherwise conventional, document feeder into which the operator feeds the original documents to be copied also functions in a dual mode as the machine function selector or controller input, in combination with a simple, low cost, optical scanning device which does not need to read or image information, merely to sense the presence or absence of light and dark areas in a known manner. Since the information to be read is fed past the optical scanning means at a known location and speed, the scanner may be even less sophisticated than those now in widespread use for reading product and price code information on products in grocery stores, etc.. For example, it can be a simple mirror galvanometer or other scanner as disclosed in U.S. Pat. No. 3,723,640.

Furthermore, with the present system, the copier feature control selection can be made in advance or just before copying. It can be made by ordinary available manual marking indicia such as pencils, pens, etc.. The control sheets can even be copies of other control sheets, made on the same copier that is being controlled or another copier. The control function selection is basically self-explanatory on and from this control medium itself. No card keypunch machines, keyboards, typewriters, magnetic or optical or other sophisticated or expensive indicia recording apparatus is required to encode the selections.

Further features and advantages of the invention will be better understood by reference to the following description, and to the drawings forming a part thereof, wherein.

Referring now first to previously disclosed details of the exemplary copier 10 shown in the Figures, especially its automatic document feeding unit 20, it will be appreciated that this system is merely exemplary, and that various other recirculating or non-recirculating document feeding units, and copiers, automatic or semi-automatic, may be utilized with the present invention, including various ones disclosed in the above-cited references. The exemplary system here is disclosed in even more detail in an allowed U.S. application filed Aug. 18, 1977 as Ser. No. 825,743 and published Mar. 1, 1979, as German OLS No. 2,828,669 and in related allowed application Ser. No. 825,751, filed on the same date now U.S. Pat. No. 4,166,614 issued Sept. 4, 1979.

Figure 1:
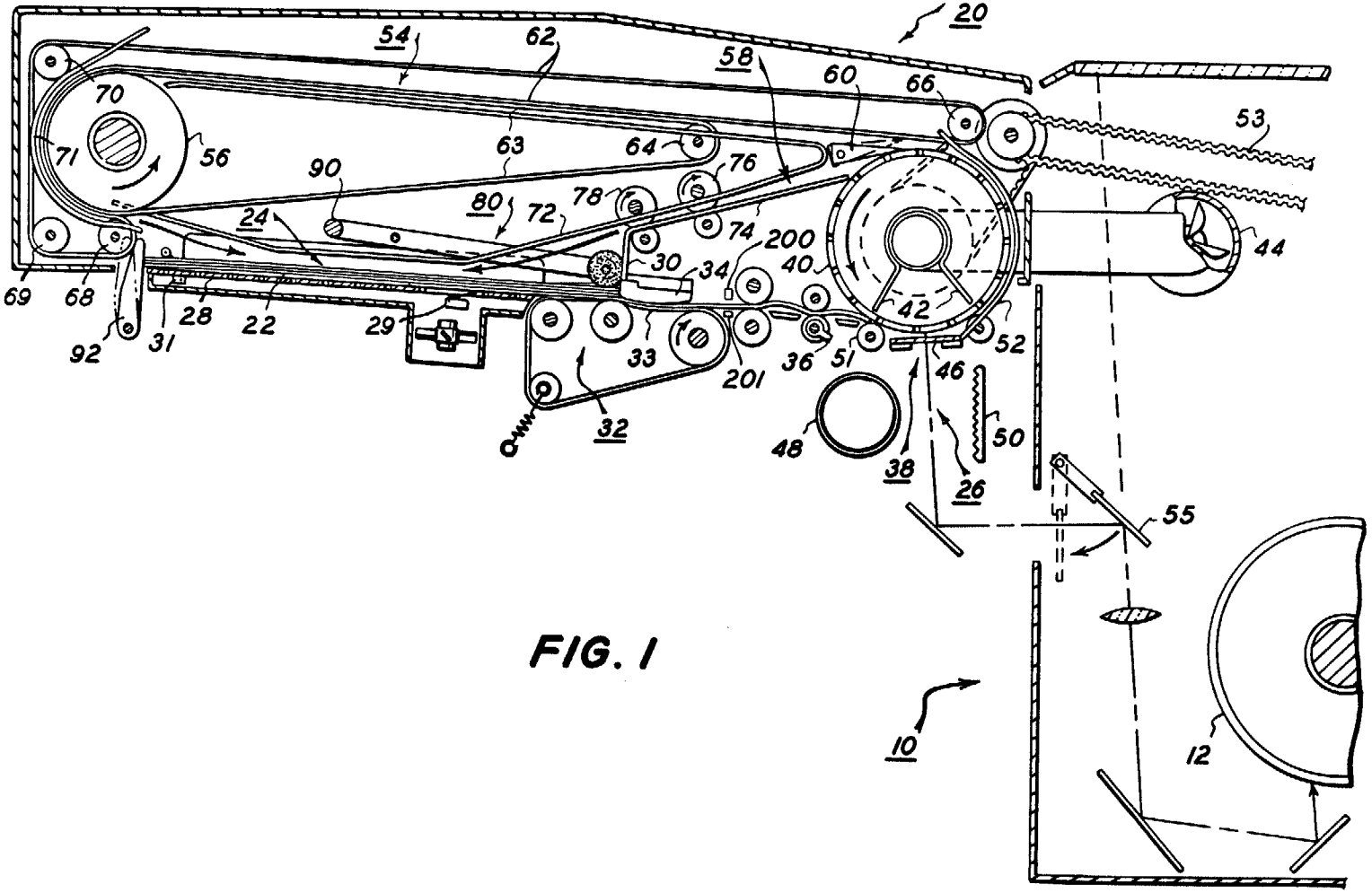
FIG. 1 is a partial side view of an exemplary copier showing a document feeder incorporating the present invention.

Briefly, referring particularly to FIG. 1, in the recirculating document handler (RDH) 20 here, individual original documents 22 are sequentially fed from the bottom of a stack of documents (placed by the operator in the document storage area 24) to the imaging station 26 to be conventionally imaged onto a photo-receptor 12 for the production of copies in a conventional xerographic manner. Here the imaging station 26 is a "slit scan", moving document, imaging station. However, it will be appreciated that the imaging station for the document feeder may alternatively be the conventional, existing, full size platen of a copier for full frame or moving optics scanning exposure of a stationary document thereon. The document storage area 24 includes a stacking tray 28 with a front stack stop 30 and switches such as 29 for sensing the presence of documents in the tray 28 to automatically initiate copying. A conventional moving bail and associated switch 31 indicates each circulation of the document set and is automatically reset on the topof the stack before the next circulation. The document feeder 20 is conventionally adapted to reliably feed only the conventional sizes and weights of sheets of paper, containing conventional information Referring now in further detail to the specific novel features of the present invention which operate in combination with the above-described systems, particular attention is directed to the exemplary optical scanners 200 or 201 for scanning the document before it is imaged, as positioned, for example, in FIG. 1. An example of one optical scanning means 200 is particularly shown in FIG. 2.

The exemplary optical scanning means 200 illustrated here is of the well known, conventional, rotating polygon mirror type. A columnated light source, from a LED or other lamp focused through a lens, or other appropriate light source, is controlled as a sweeping narrow light beam by being reflected off the rotating mirror surface of the device. This provides a "flying spot" sweep or scan across the document 22 as it is being fed by the existing document feeding system in the document feeder. The light from this light source which is reflected back in the same or other path is converted by a conventional photodiode or other light detector to electrical signals corresponding to the amount of reflected light. In the present system, since this is a simple, low cost optical scanner which does not need to read or transmit actual images on the document, the reflected light signals are merely converted to electrical pulses corresponding to the presence or absence of a light reflection, i.e., corresponding to light and dark indicia areas on the document sheets. Since the document is being fed at a known constant speed, and since the optical scanning means is also scanning across the documents at a known and constant speed, these electrical pulses will correspond in spacing and duration directly to the spacing and duration of the light and dark areas on the document being scanned. Thus, for predetermined patterns of light and dark areas, control signals may be provided simply by connecting this simple optical scanning device to the copier controller 100, and utilizing the existing electronic capacity thereof, in a known manner. The pulse train output of the photodetector 200 can be stored in a conventional buffer/register, controlled and coordinated with the controller routines and clock pulses. The pulse train may then be conventionally compared with either programmable or read-only memory stored in the controller. That is, an indicia pattern read on the document can be compared to a pre-programmed code pattern in the controller. Where the comparison is positive, the controller knows that the identified indicia pattern has been read at that time. That comparator information in turn can be conventionally used to initiate other pre-existing controller programs, to control the operation of the copier in a known manner.

By the appropriate construction of the optical scanner and the connecting circuitry, various suitable indicia patterns can be selected for the appropriate encoding. One well known indicia encoding pattern is that utilized, for example, for product marking codes on consumer products to be read by optical scanners in the checkout stations of grocery and other stores. This is a pattern of inter-mixed thin and thick dark lines with defined spacings therebetween, which generate a corresponding pulse code pattern by that optical scanning. An example is disclosed in U.S. Pat. No. 4,135,663 issued Jan. 23, 1979.

The present system is much simpler than those commercial scanning systems because the document is in a known position and moving at a known speed at all times so that the optical scanner can be in a fixed position and scan along a single line. In fact, if the optically encoded information to be read on the document sheet is linearly aligned along a line running in the direction of feeding of the document sheets, the optical scanning device could be a stationary single point scanner without any scanning mechanism. Its output pulses would be provided by the movement of the line of coded indicia past the scanning device. This is illustrated by the alternative or additional exemplary optical scanning device 201 shown reading the opposite sides of the documents being fed. This sensor can even be the existing sheet lead edge or jam detector utilized in the above-cited and other document handling systems for sensing the presence or absence of a document by means of a light source and a spaced photodetector, either of a reflective type or a transmissive type.

Various other alternatives may be provided for either of the detectors 200 and 201. As noted in the introduction, the detector 200 can be a simple oscillating mirror galvanometer scanner. Other alternatives include fiber optics in single or multiple arrays or charge-coupled devices.

Figure 4:
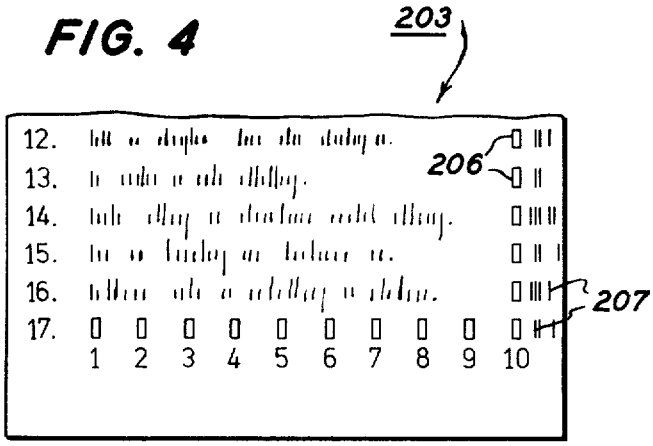
FIG. 4 is a portion of an exemplary control sheet to be fed into the copier document feeder of FIGS. 1, 2, and 3.

As previously noted in the introduction, with the present system, simple operator markable control sheets are utilized to control the various operations of the copier selected for selected documents. FIG. 4 illustrates an example of a portion of one such control sheet. The control sheet 203 illustrated in FIG. 4 is a conventional sheet of paper or other suitable material of the conventional document size, weight, and material of any other document sheet and appropriate to be fed in the same manner as any other document sheet through the document feeder. That is, it is not a "IBM card", tape, disc, or other special substrate. It is preferably the same business-sized cut sheet paper which is provided as copy paper for the copier. In fact, it is preferably generated by making a copy of a master original on the copier in a conventional manner.

The control sheet 203 has a plurality of defined operator selectably markable indicia areas 206 thereon which are identified by adjacent pre-printed locating and identifying indicia. Each of these selectable marking areas corresponds to different operator selectable operations of the copier. For example, in FIG. 4, the portion of the control sheet 203 there includes pre-printed directions and identifications to the operator for selectable operations numbered 12 through 17. Each numbered item includes a pre-printed conventionally operator readable identification of the item to be selected, as well as a machine readable code pattern 207. Examples of numbered items would be: the degree of magnification or reduction; whether or not screening is to be provided; whether or not, or to what degree to darken or lighten the document image; the number, type and position of cover sheets or inserts; etc.. The operator simply goes down the list and marks the selected operations by marking their respective selection areas 206 with a conventional dark pencil, pen, felt tipped marker, etc.. If a "box" 206 is not marked, it means that the function identified by its adjacent descriptive material is not selected.

Example item No. 17 on the control sheet 203 of FIG. 4 illustrates a "multiple choice" item which could be, for example, the sequence of selected inserts. For example, if boxes "4" and "6" are marked by the operator, this can be the selection for automatically feeding an insert sheet from one of the above-described alternate copy or insert trays immediately after the fourth and indicia to be copied, e.g., printed or typed letters, drawings, photographs, etc..

In this disclosed system, a bottom feeder 32 comprising a feed belt 33 and retard pad 34 feeds the bottom document sheet, on demand, to a registration gate 36 for de-skewing and registering the sheet prior to feeding it into the scanning slit 38 at the imaging station 26. In this document feeder the document is fed through the imaging station by a vacuum cylinder or roller 40 having an internal manifold 42 connected to a vacuum blower 44. The rotation of the roller 40 by a drive belt 53 from the copier moves the document 22 past a transparent window 46 where it is illuminated by a lamp 48 assisted by a Fresnel reflector 50.

The further movement of the document 22 around the outside half of the roller 40 is a first inversion, and is assisted by rollers 51 and paper guides 52. At the top of the roller 40, i.e., after the document has been turned over once, there is a decision gate comprising pivotable deflector fingers 60 which determines the further recirculatory movement of the documents through a selected one of two different return transport paths back to the tray 28. These two paths are a first (simplex) belt transport path 54 and a second (duplex) transport path 58. The second or duplex transport 58 returns the documents directly to their storage area 24 for restacking from the first inverting roller 40, i.e., with only a single inversion. In contrast, the first or simplex transport path 54 transports the documents around a second inverting roller 56 and returns them to the same tray 28 after having been inverted twice. Therefore, the solenoid or other actuation of the selector fingers 60 determines whether the documents are recirculated with one or two inversions. With two inversions the same sides of the documents are exposed in each circulation and restacked in the tray 28 in their original orientation. With one inversion the documents are restacked in the tray 28 inverted from their previous orientation, which provides for copying of the opposite sides or faces of the documents on their next circulation.

The alternative of conventional manual copying of individual documents on the conventional platen is provided here by the pivotal mirror 55. It can also be provided by conventionally pivotally removably mounting the RDH 20 over the platen.

The exemplary simplex path transport 54 here comprises an opposing pair of central belts 62 and 63 supported on rollers 66, 68, 69, and 70. These belts wrap around, and transport the document around, the second inverting roller 56 until the document is discharged into the rear or downstream end of the tray 28 here. A baffle 71 may be additionally provided to help guide the document in its second inversion around the outside half of the roller 56.

The exemplary duplex path transport 58 here is provided by spaced opposing baffles 72 and 74 guiding the sheets through roller pairs 76 and 78. These drive the document sheets into the front of the tray 28.

It may be seen that both the simplex transport 54 and duplex transport 58 continuously restack the sheets after they are copied on the top of the stack of sheets in the tray 28. Thus, continuous multiple recirculations for pre-collation copying may be provided.

Figure 2:
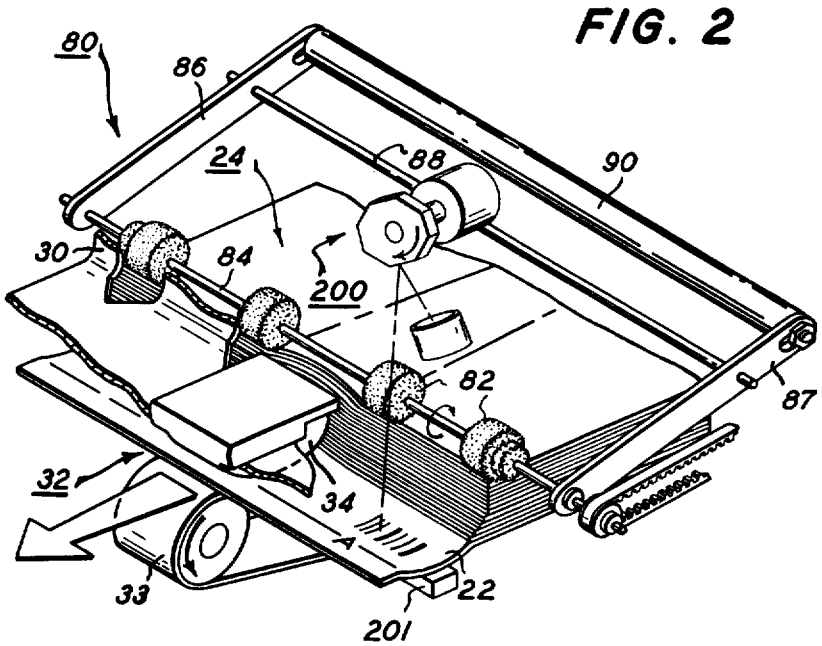
FIG. 2 is a partial perspective view of the document feeder of FIG. 1.

In this example, the restacking and feeding of the documents is assisted by an integral normal force applicator and jogger unit 80, further shown in FIG. 2. Here this includes soft foraminous jogging wheels 82 on a driven shaft 84 which is pivotally supported by arms 86 and 87 mounted at opposite sides of the stack on a mounting shaft 88 and counterweighted by a counterweight 90. Thus, the rollers 82 capture and jog forward documents against the front stack stop 30, but do not obstruct restacking, and provide relative slip and a slight normal force. A rear stack jogger 92 and a side jogger (not shown) may be additionally provided, if desired. Pneumatic air flotation of the stack from holes in the bottom of tray 28 to assist feeding is also illustrated.

Figure 3:
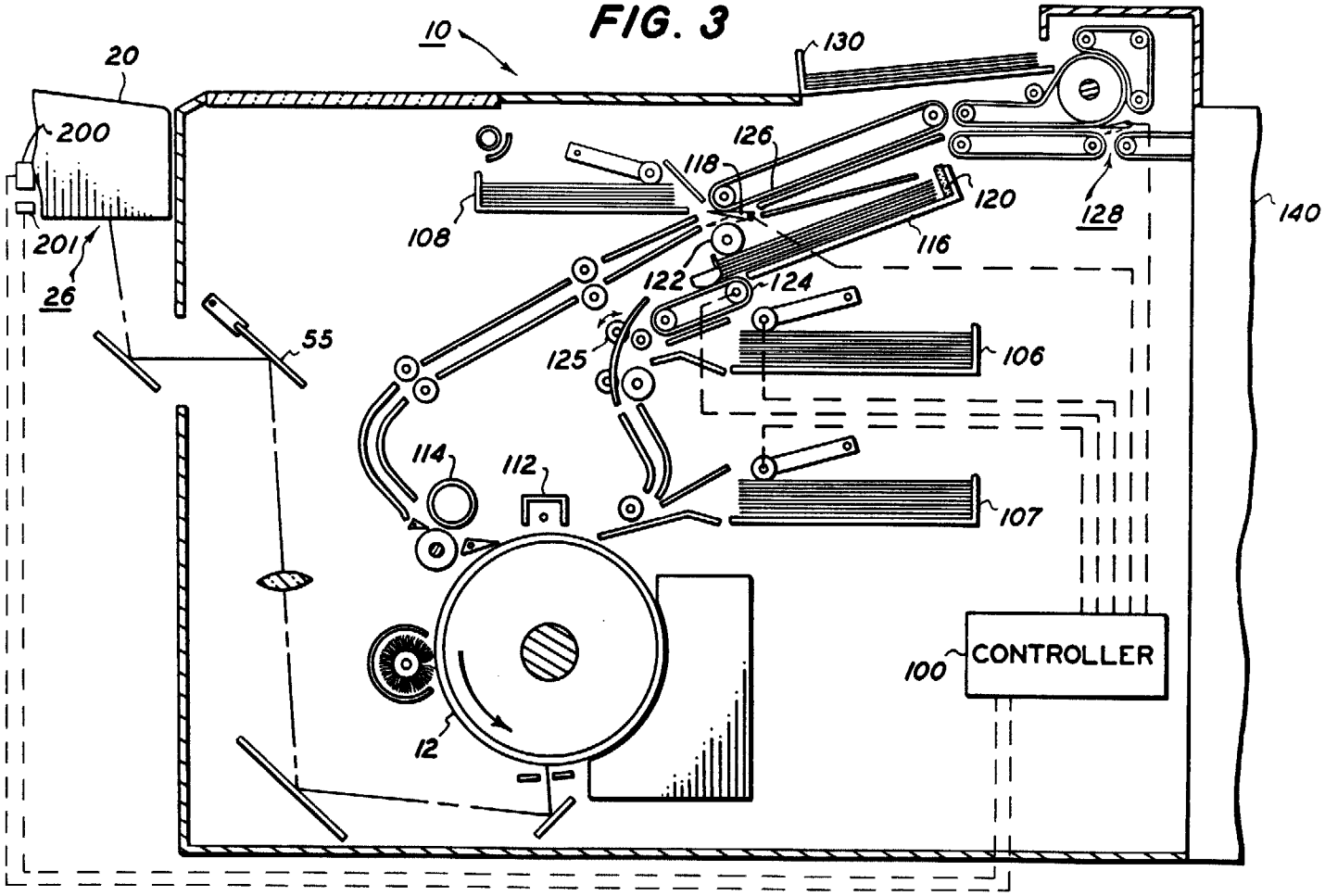
FIG. 3 is a side view of the copier of FIGS. 1 and 2.

Turning now to FIG. 3, the exemplary copier 10 processor and its control will be described in further detail. It provides duplex or simplex pre-collated copy sets from duplex or simplex original documents copied by the RDH 20. It may be seen that two separate copy sheet trays 106 and 107 are provided to feed copy sheets onto which the images of the documents are to be printed. The control of which of the trays from which sheets are to be fed is by the machine controller 100. The controller 100 is preferably of the known programmable microprocessor type exemplified by the patents cited in the introduction, which conventionally also controls all of the other machine functions described herein including the operation of the document feeder, all the decision gates, feeders, copy density, copy optical reduction or screening, etc.. For "book" programming one of the trays 106 and 107 may contain colored and/or heavy card stock, transparencies, tabed insert sheets, or other suitable cover or insert sheets to be automatically fed at the appropriate copy sheet intervals for each of the pre-collated copy sets which the copier 10 produces from each circulation of the document set. For pre-printed or blank covers or other non-copy inserts several additional inserter trays such as 108 can be provided for direct output without printing, but interleaved with the copies.

The regular copy sheets, or copy cover or insert sheets to be printed, are fed from trays 106 or 107 to the conventional xerographic transfer station 112 for imaging one side thereof, then to the conventional fusing station 114. From there, depending on the position of a duplex selector finger or gate 118, the copy sheets will be deflected either into a duplex buffer storage tray 116 or into the copy output path of the copier via output transport 126. The duplex tray 116 here includes a bounce reverser 120 and jogger/normal force wheels 122 for the stacking of copy sheets therein and assistance in bottom feeding from the duplex tray 116 by a bottom feeder 124. For duplex copying the previously simplexed copy sheets in the tray 116 are fed by the feeder 124 back to the transfer station 112 for the imaging of the second or opposite page image on the opposite sides thereof. Such now-duplexed copy sheets are then fed out past the now-opened gate 118 into the output transport 126.

As an alternative to feeding the sheets from the tray 116 back to the transfer station 112, reversible feed wheels 125 are provided to reverse the motion of the sheets fed out of the feeder 124 and to feed these sheets directly back through the gate 118 into the transport 126 without imaging their opposite sides.

The output transport 126 transports the finished copy sheets to an output inverter gate 128 where the sheets may be further inverted, and, if desired, placed in the output tray 130. Alternatively, the copy sheets may be fed to a conventional finishing station 140 for the stapling, stitching, gluing, binding, or off-set stacking of the completed, pre-collated, copy sets.

sixth pages in each document set. Additional multiple choice selectors like 17 may be provided for other inserts, or other special processing of selected documents. Further, operator markable selections can be provided for feeding selected inserts into only a selected number of the document sets, rather than all sets. The choice of functions or operations is not even limited by the convenient amount of information selection that can be printed on the control sheet. Different control sheets can be provided for different types of operations to provide an expanded choice, and more than one control sheet can be fed in sequence to provide the total control program selection, since the number of unique function codes is effectively unlimited.

As indicated, the control sheet will contain preprinted encoding indicia thereon which is readable by the optical scanning means in addition to the operator marked indicia areas. In FIG. 4, a different bar pattern 207 is positioned adjacent each operator selectable marking area. Each bar pattern provides an electrically distinguishable pulse train (bit code word) signal to the controller just before the optical scanner scans across the operator markable area. It identifies to the controller logic the function which is about to be selected, or not selected, just before that selection is read by the next, and lengthy, pulse from the scanner reading the presence or absence of a dark (marked) area at the marking position 206. Trail bit codes can be used alternatively or in addition to lead bit codes 207.

It will be noted that with this system, that the copier operator simply conventionally marks boxes, similar to those familiar from machine-readable tests, examinations or ballots. Any literate person can simply fill in these boxes in response to specific written questions. No special training is required. The control sheet may even be marked in advance by someone other than the operator. All other information, including the identifying codes, instructions, and questions may be pre-printed on the master control sheet. Any number of copies can be made from such a master sheet and used as control sheets. The control sheet copies can be unmarked in all the indicia areas 206, or they can be partially or fully pre-marked in some of those areas for a particular job. Copies of pre-marked specific programs may be inserted at different locations within the same document stack, or for subsequent jobs. For example, if it were desired to print certain pages of a document with a selected different color or weight for various runs, a control sheet with appropriate boxes marked thereon could be copied and inserted before all the selected document pages in document sets for which this same copy feature is desired. Particularly where the control sheet is positioned to be fed before any of the other documents, i.e., at the top or bottom of the document stacks, or otherwise fed through before the other documents, the control sheet can be utilized to provide the entire and only control of the copier, including even the selection of the number of copy sets, to be made.

Preferably a lead edge area of the control sheet 203 includes a specific inhibit copying code indicia (illustrated by way of example in the marking provided on the document sheet 22 being fed in FIG. 2) pattern which instructs the controller (by comparison with a stored control code) to not copy the control sheet. This allows control sheets to be fed through the document handler in the normal manner, as if they were to be copied like any other document sheet, without their actually being copied. The controller 100 simply inhibits the normal copying operation for those sheets in response to receiving the inhibit signal from the optical scanner. This copying inhibition mode is accomplishable in various known ways. For example, copying can be prevented by inhibiting the document illumination system or by discharging the photoreceptor in the image area from the control sheet, etc.

If it is desired to save the document feeding time of recirculating the control sheets, means may be provided for ejecting or otherwise not circulating the control sheets from the document handler after the first document circulation. That is, the encoded instructions thereon may be read once and stored electronically in the copier controller to control all of the subsequent recirculations of that document set, or until another control sheet is read.

While the optical scanning means 200 or 201 is primarily adapted to simply visually "pre-scan" each document sheet being fed for the presence or absence of the above-discussed control information indicia, and not to actually read the visual information thereof, it can be utilized in an additional mode of operation to scan and control document sheets other than the control sheets 203. In this mode of operation, the same optical scanning means and the electronic controller 100 are further adapted to sense the presence or absence of any indicia at all on one side of an individual document sheet being fed by the document feeder, and in response to not sensing any indicia thereon, to automatically inhibit the copying of that indicia-free side of that document sheet by the copier. In other words, this system determines whether or not each document sheet is a simplexed document or a duplexed document, and controls its copying accordingly. If it senses a duplex document it will cause it to be processed by the document handler and copier in a known manner to copy both sides of the document sheet, and also control the operation of the copy sheet feeder system of the copier appropriately, and vice-versa for a simplex document.

In this mode of operation the presence of indicia of any form on the side of the document sheet being scanned will generate a series of pulses from the scanner corresponding to the light and dark areas of the information indicia. By storing segments of the output of the optical scanner in a controller buffer and counting the total number of generated pulses in a given time segment in comparison with the controller clock, it can be readily determined whether or not the document sheet is effectively optically blank, i.e., indicia-free, or not. That is, if there are a significant number of pulses (above a threshold count level selected to eliminate noise or other intermittent scan pulse inputs) the copier controller will proceed to automatically treat the document as a duplex document.

It will be noted that in the RDH of the type described herein, where the document may be selectively inverted, that a single sensor may be utilized to scan both sides of a document sheet on alternate circulations. Alternatively, two sensors or scanning systems on opposite sides of the document may be utilized. As another alternative a mirror system may be utilized to connect a single sensor to two different locations in the document path.

A further single sensor alternative is based on an assumption that a document sheet will normally only be blank on its even page numbered side. For example, a three page duplex document set will normally have pages 1 and 2 on opposite sides of the first document sheet, and page 3 on the first side of the second document sheet. Thus, the opposite, even page side, of the second document sheet will be the one blank, i.e., the second document sheet is simplexed on the odd page side. Thus, by positioning the documents to be fed in relation to a single optical scanner so that the even page sides are fed past that scanner, that single scanner will detect most simplexed documents.

With these detection systems it may be seen that simplex and duplex original documents can be freely randomly inter-mixed in a document set and automatically fed without interruption or special processing by the document feeder. The copier will automatically provide the requisite changes in copying, including any required inversion and refeedings of the duplex documents and copies, by automatically sensing and indicating to the controller whether each document sheet is simplex or duplex.

Numerous variations, modifications, and implementations using known encoding and electronic techniques will be obvious from the above to those skilled in that art. Numerous other controllable copier structures and functions will likewise be obvious to those skilled in the xerographic or other copier arts. The following claims are intended to encompass all of those falling within the true spirit and scope of this invention.

What is claimed is:

1. In a copier with a document feeder for feeding conventionally sized original document sheets with conventional information indicia on one or both sides thereof to a document imaging station to be copied onto selected copy sheets in said copier, which copier is controlled by an electronic controller, the improvement wherein:

said document feeder has a non-imaging optical scanning means therein for optically scanning the document sheets being fed by said document feeder before they are copied to provide electrical pulses corresponding to light and dark indicia area of said document sheets; and wherein a control sheet of said conventional document size is adapted to be insertable into said same document feeder in the same manner as said original document sheets;

said control sheet has a plurality of defined operator selectably markable indicia area thereon, identified by adjacent pre-printed locating and identifying indicia thereof, said selectable markable areas corresponding to different operator selectable operations of said copier;

said operator markable indicia areas on said control sheet are adapted for reading by said optical scanning means; and said optical scanning means is connected to said electronic controller of said copier to control the operation of said copier with said operator markable indicia as said control sheet is fed by said document feeder, including means to automatically inhibit the copying of said control sheet by said copier by indicia areas thereon;

wherein said same optical scanning means and said electronic controller are further adapted to sense the absence of any indicia on one side of an individual document sheet being fed by said document feeder and to automatically inhibit the copying of that indicia-free side of that document sheet by said copier.

2. The copier of claim 1, wherein said document feeder inverts said document sheets and re-feeds said document sheets past said same optical scanning means to scan the opposite sides thereof, to determine the presence or absence of indicia on both sides of said document sheet utilizing only a single sensor positioned at only one side of the path of said documents.

3. The copier of claims 1 or 2, further including at least one inserter tray, and wherein one said operation controlled by said controller is the feeding of inserts from a said inserter tray directly to the output of the copier interleaved with copies made in the copier.

4. In the method of copying in which conventionally sized original document sheets with typewritten or other conventional information indicia on one or both sides thereof are fed by a document feeder to a copier for copying thereof, and which copier has an electronic controller, the improvement comprising:

providing a control sheet with a plurality of defined operator selectable marking indicia area locations thereon corresponding to a selection of different selectable copier operations, said control sheet being substantially the same size as the document sheets to be copied and feedable in the same manner as said document sheets by said document feeder, marking said control sheet with conventional marking indicia at selected ones of said selectable indicia area locations thereon corresponding to selected copier operations, feeding said control sheet into said document feeder in the same manner as said document sheets, associated with document sheets whose copying is to be controlled thereby, automatically reading said marking indicia on said control sheet while it is being fed by said document feeder with an optical scanning device which converts said marking indicia to electrical signals, and connecting said electrical signals from said optical scanning device to said electronic controller to control the operation of said copier for the copying of one or more documents fed by said document feeder with said associated control sheet, wherein said copier has both simplex and duplex modes of copying operation, including the further steps of scanning all of said document sheets with said same optical scanner as they are fed by said document feeder for copying in said copier, to sense if one side of a document sheet contains information indicia or not, and in response to sensing that one side of a document does not contain information indicia to automatically switch said copier to said simplex copying mode of operation for that document sheet, and in response to sensing that said side of said document does contain information indicia to automatically switch to said duplex copying mode of operation for that document sheet.

5. In a method for automatically variably copying a set of original document sheets in a selectably multifunctional copier wherein said document sheets are automatically fed seriatum by a document feeder in a direction of movement to said copier, the improvement comprising:

intermixing, and commonly feeding said document sheets, with said document feeder, correspondingly sized control sheets bearing operator selectably markable optical indicia locations each associated with adjacent pre-printed unique digital optical encoding patterns indicative of unique selectable said copier functions, scanning in the same manner both said document sheets and said control sheets across their transverse dimensions by scanning transversely of said direction of motion with the same stationary electro-optical line scanner as they are fed in said direction of motion by said document feeder, providing an output signal in a form of a stream of digital pulses from said electro-optical line scanner, automatically inhibiting the copying of said control sheets, automatically inhibiting the copying of a document sheet which has been so scanned in response to sensing an output signal containing less than a predetermined minimum of said digital pulses in a predetermined time period, and copying a document sheet which has been so scanned, with selected ones of said selectable copier functions, in response to sensing a stream of digital pulses corresponding to the scanning of both a marked said indicia location and its associated pre-printed unique digital incoding pattern.

6. In the method of copying in which conventionally sized original document sheets with typewritten or other conventional information indicia on one or both sides thereof are fed by a document feeder to a copier for copying thereof, and which copier has an electronic controller, the improvement comprising:

providing a control sheet with a plurality of defined operator selectable marking indicia area locations thereon corresponding to a selection of different selectable copier operations, said control sheet being substantially the same size as the document sheets to be copied and feedable in the same manner as said document sheets by said document feeder, marking said control sheet with conventional marking indicia at selected ones of said selectable indicia area locations thereon corresponding to selected copier operations, feeding said control sheet into said document feeder in the same manner as said document sheets, associated with document sheets whose copying is to be controlled thereby, automatically reading said marking indicia on said control sheet while it is being fed by said document feeder with an optical scanning device which converts said marking indicia to electrical signals, and connecting said electrical signals from said optical scanning device to said electronic controller to control the operation of said copier for the copying of one or more documents fed by said document feeder with said associated control sheet, wherein as a first step said control sheet is generated in said copier.

7. In the method of copying in which conventionally sized original document sheets with tupewritten or other conventional information indicia on one or both sides thereof are fed by a document feeder to a copier for copying thereof, and which copier has an electronic controller, the improvement comprising:

providing a control sheet with a plurality of defined operator selectable marking indicia area locations thereon corresponding to a selection of different selectable copier operations, said control sheet being substantially the same size as the document sheets to be copied and feedable in the same manner as said document sheets by said document feeder, marking said control sheet with conventional marking indicia at selected ones of said selectable indicia area locations thereon corresponding to selected copier operations.

feeding said control sheet into said document feeder in the same manner as said document sheets, associated with document sheets whose copying is to be controlled thereby, automatically reading said marking indicia on said control sheet while it is being fed by said document feeder with an optical scanning device which converts said marking indicia to electrical signals, and connecting said electrical signals from said optical scanning device to said electronic controller to control the operation of said copier for the copying of one or more documents fed by said document feeder with said associated control sheet, wherein said selectable indicia area locations have associated adjacent unique visual pre-printed encoding, and said encoding is read together with said marking indicia to provide identifiable encoded control signals to said controller.

8. The method of claims 5 or 6, wherein said copier is so controlled to feed inserts from one or more inserter trays directly to the output of the copier interleaved in the output with copies made in the copier.

* * * * *